United States Patent [19]

Yazawa et al.

[11] 4,335,070

[45] Jun. 15, 1982

[54] METHOD OF MANUFACTURING A RETICULAR WEB HAVING REINFORCED SELVAGES

[75] Inventors: Masahide Yazawa; Hiroshi Yazawa, both of Kunitachi; Haruhisa Tani; Kazuhiko Kurihara, both of Tokyo, all of Japan

[73] Assignees: Nippon Petrochemicals Co., Ltd.; Polymer Processing Research Institute, Ltd., both of Japan

[21] Appl. No.: 222,972

[22] Filed: Jan. 7, 1981

[30] Foreign Application Priority Data

Jan. 12, 1980 [JP] Japan ..... 55-2315

[51] Int. Cl.[3] ..... B29D 00/00; B29D 7/14

[52] U.S. Cl. ..... 264/555; 264/103; 264/288.8; 264/289.6; 264/230; 264/342 RE; 428/192

[58] Field of Search ..... 428/192; 264/288.8, 264/289.6, 103, 555, 500, 230, 342 RE

[56] References Cited

U.S. PATENT DOCUMENTS 4,116,892 9/1978 Schwarz ..... 264/288.8

4,251,585 2/1981 Schwarz ..... 264/288.8

*Primary Examiner*—James J. Bell

*Attorney, Agent, or Firm*—Robert E. Burns; Emmanuel J. Lobato; Bruce L. Adams

[57] ABSTRACT

A reticular web of thermoplastic resin composed of split or slit fibers is longitudinally fed around a system of nip rollers as it is transversely spread along its selvages which then longitudinally shorten into contact with small-diameter end portions of one of the nip rollers. At least one dimensionally stable thread is attached to and along each of the web selvages to reinforce the latter. The web thus laterally spread is caused to heat-shrink at its middle portion on a heated drum until the middle portion is of substantially the same length as that of the selvages. Each of the selvages including the thread has a basis weight which is substantially the same as or smaller than that of the middle portion. The selvages of the reticular web thus treated are rendered dimensionally stable for guidance of the web in a manner to keep the latter constant widthwise while the web is wound around or reeled out from a take-up roll.

9 Claims, 11 Drawing Figures

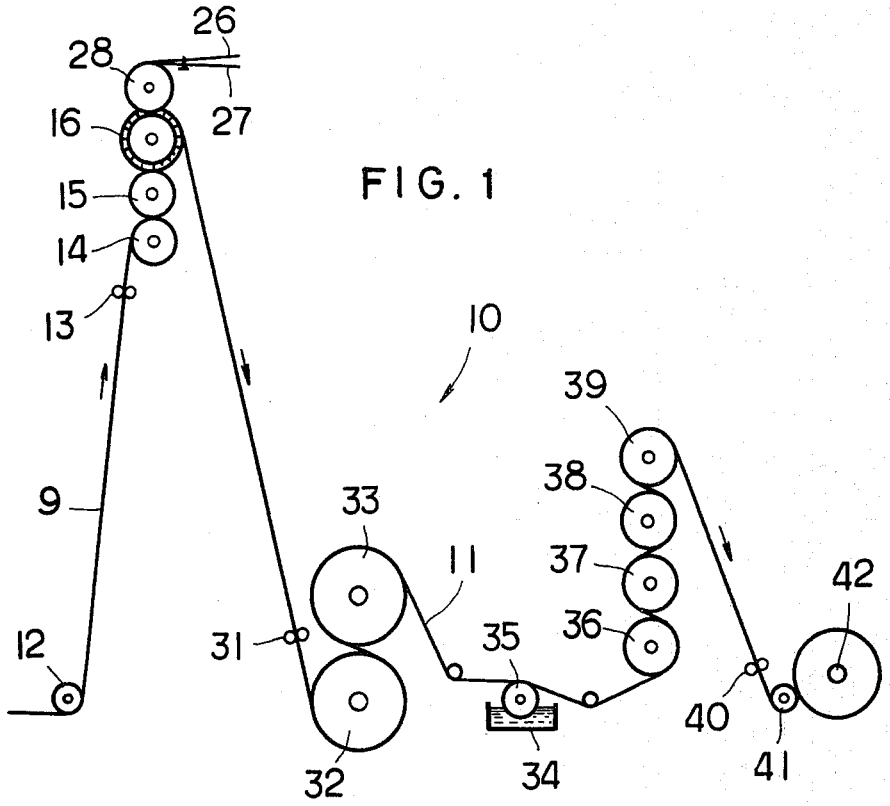
FIG. 1
FIG. 2
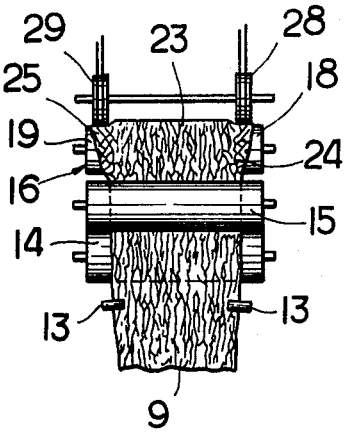
FIG. 3
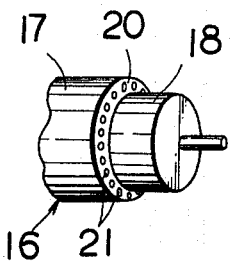
FIG. 4
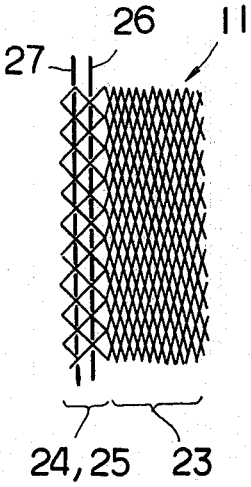
FIG. 5
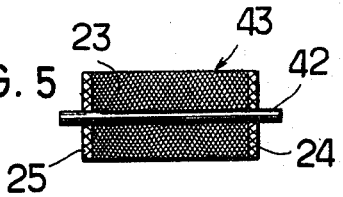

METHOD OF MANUFACTURING A RETICULAR WEB HAVING REINFORCED SELVAGES

BACKGROUND OF THE INVENTION

1. Field of the Invention

The present invention relates to a method of manufacturing a reticular web of thermoplastic resin composed of split or slit fibers integrally joined together at intervals along the length thereof which has reinforced and dimensionally stabilized selvages, and more particularly a method for continuously manufacturing such a web.

2. Prior Art

Reticular webs of thermoplastic resin composed of split or slit fibers integrally joined together at intervals along the length thereof or having longitudinal discrete cuts are difficult to handle when spread transversely since the fibers or meshes are positionally unstable and hence tend to be shifted under tension as when the web is reeled out. More specifically, the web undergoes undue spreading along selvages thereof which are gripped by cloth guiders for guiding the web while the latter is being paid out, with the result that the web will have irregular meshes widthwise. To cope with this difficulty, such reticular webs, upon having been transversely spread, are customarily bonded together warpwise and weftwise in layers so as to be marketable as stable nonwoven web materials.

There has been a need for reticular webs to be available as such in the market so that they can be used as for example, outer layers in a laminate having an intermediate film layer or as reinforcing layers for use in combination with pulp, paper, film and the like.

SUMMARY OF THE INVENTION

According to the method of the present invention a fibrous reticular web of thermoplastic resin having a pair of opposed selvages is manufactured by transversely spreading the salvages on, and wrapping the salvages around, a roller till they are reduced in length and drawn into contact with small-diameter end portions of the roller. The transverse spreading of the selvages is effected by, for example, blowing an air blast or developing air suction on the selvages, or rotating by a brush wheel held in contact with the selvages. At least one dimensionally stable thread is attached by adhesive bonding to each selvages along its length to reinforce and dimensionally stabilize the latter. The middle portion of the reticular web between the selvages is transversely spread at a smaller magnitude than the selvages and is then longitudinally shrunk on a heated drum until the middle portion has substantially the same length as that of the selvages. The reticular web thus treated can be guided or handled with ease as when wound on a take-up roll or reeled out therefrom since the selvages are reinforced and rendered dimensionally stable.

It is an object of the present invention to provide a method of manufacturing a reticular web of split or slit fibers which is dimensionally stabilized along the selvages thereof for easy handling in use.

The above and other objects, features and advantages of the present invention will become apparent from the following description when taken in conjunction with the accompanying drawings which show apparatus for carrying out some preferred embodiments of the method according to the present invention.

BRIEF DESCRIPTION OF THE DRAWINGS

FIG. 1 is a schematic side elevational view of an apparatus for carrying out the method according to the present invention;

FIG. 2 is an enlarged front elevational view of a system of nip rollers for transversely spreading the selvages of a fibrous reticular web;

FIG. 3 is a fragmentary perspective view of one of the nip rollers shown in FIG. 2;

FIG. 4 is an enlarged fragmentary view of a transversely spread reticular web;

FIG. 5 is a cross-sectional view of a take-up roll;

DETAILED DESCRIPTION

Figure 6:
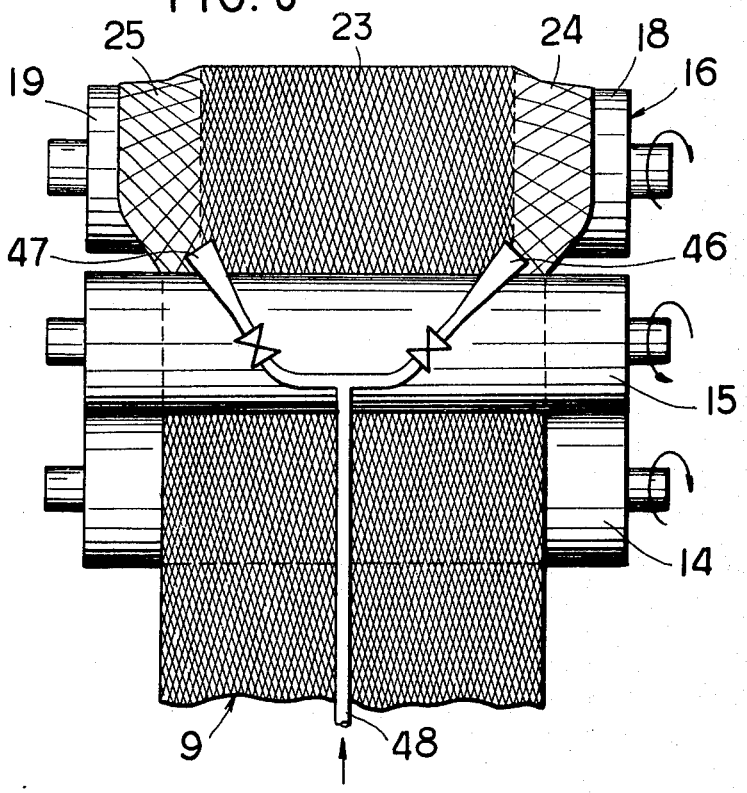
FIG. 6 is an enlarged front elevational view showing a web spreader for practicing the present invention.

FIG. 1 shows an apparatus 10 for manufacturing a nonwoven reticular web 11 having reinforced, dimensionally stabilized selvages. A longitudinally stretched, nonwoven reticular web 9 of thermoplastic resin composed of split or slit fibers integrally joined together at intervals along the length thereof is longitudinally fed around a guide roller 12 toward cloth guiders 13 (FIGS. 1 and 2), which laterally spread the web 9 by 5–10% of the width of the starting web 9. The web 9 is then caused to travel around nip or pinch rollers 14,15,16 rotatively driven by a motor (not shown).

The uppermost one 16 of the nip rollers comprises a barrel including, as best shown in FIGS. 2 and 3, a larger-diameter middle portion 17 and a pair of smaller-diameter end portions 18,19 between which the middle portion 17 is disposed. An annular shoulder 20 is defined between the middle portion 17 and each of the end portions 18,19 and has herein a series of holes or orifices 21 opening axially of the roller 16. The middle portion 17 is coupled to an air compressor (not shown) for blowing an air blast through the holes 21 axially over the smaller-diameter end portions 18,19.

The web 9 travels between the nip rollers 14,15,16, and is wrapped partly around the roller 16, only the middle portion 23 (FIG. 2) of the web along its length being nipped between the nip roller 15 and the larger-diameter middle portion 17 of the nip roller 16 and the opposite selvages or longitudinal marginal edges 24,25 of the web 9 overhanging the smaller-diameter end portions 18,19, respectively, therearound. An air blast discharged through the holes 21 in the shoulders 20 impinges upon the selvages 24,25 to spread the fibers thereof transversely away from each other, whereby the selvages 24,25 are caused to shrink longitudinally or shorten until they are brought radially inwardly into contact with the surfaces of the smaller-diameter end portions 18,19. Upon contact with the smaller-diameter end portions 18,19, the selvages 24,25 are forced to travel therewith in an arcuate path in which they are prevented from being laterally spread further. Thus, the amount of transverse spreading of the selvages 24,25 is automatically controlled dependent on the diametrical difference between the roller portions 17 and 18,19.

At least one, or preferably a pair of dimensionally stable threads 26,27 (FIGS. 1 and 4) such, for example, as those of flat yarn which are coated with hot-melt adhesive are guided around electrically heated pulleys 28,29 disposed on the smaller-diameter end portions 18,19 of the nip roller 16. As the threads 26,27 are fed around the pulleys 28,29, the threads 26,27 are bonded by melted adhesive to the transversely spread selvages 24,25 on the smaller-diameter end portions 18,19, as best illustrated in FIG. 4.

Upon having been thus transversely spread and dimensionally stabilized along the selvages 24,25 the web 9, which is longer at the middle portion 23 than at the selvages 24,25, is directed toward cloth guiders 31 (one set shown) which are spaced laterally from each other by a distance several times greater than the width of the middle web portion 23 as substantially unspread. On advancing movement of the web 9, the reinforced selvages 24,25 are gripped by the cloth guiders 31, whereupon the middle portion 23 of the web 9 is transversely spread and at the same time longitudinally shrunk or shortened to an extent determined by the amount of lateral spreading. In the illustrated embodiment, the amount of transverse spreading of the middle portion 23 effected by the cloth guiders 31 is made smaller than that of the selvages 24,25. The remaining excessive length of the middle portion 23 of the web 9 is removed by causing the web 9 to travel around a pair of heated drums 32,33 on which the middle portion 23 is additionally longitudinally heat-shrunk until it has substantially the same length as that of the selvages 24,25. The laterally spread and heat-treated web 11 is substantially uniform in length and reticular structure. With the width of each of the fibers in the reticular web being on the order of 1 mm or greater, each fiber tends to rise obliquely when the web is transversely spread. The greater the width of each fiber, the more the fiber undergoes such tendency. However, the fibers are held flatwise against the heated drums 32,33 and thereby heat-set is stabilized flat arrangement.

Where the starting reticular web has a warpwise diagonal length of individual fibers preferably ranging from 30 mm to 50 mm, the web is longitudinally shortened only by several percent or less when it is transversely spread two to three times. Additional heat shrinkage of the web, if limited to several to about 10%, would enhance thermal stability rather than lower mechanical strength thereof.

The treated web 11, upon having left the heated drum 33, may be wound up as an end product for shipment. However, where the treated web 11 is to be bonded to paper or be combined with pulp, the web 11 is coated with hot-melt adhesive or emulsion adhesive contained in an adhesive container 34 by a kiss roller 35 partly immersed in the adhesive in the container 34. The web 11 is then caused to travel around rollers 36,37,38,39 for uniform distribution and drying and cooling of the coated adhesive before being guided by guides 40 and a guide roller 41 toward a take-up reel 42.

As shown in FIG. 5, the web 11 is wound as a roll 43 on the take-up reel 42.

Each of the selvages 24,25 including the threads 26,27 has a basis weight which is substantially the same as or smaller than that of the middle portion 23. More specifically, it has been customary practice to reinforce paper or film with reticular webs of fibers having a tensile break strength of 4–5 g/denier which are arranged warpwise and weftwise in layers with a basis weight of either 20–25 g/m$^2$ for light reinforcement or 40–60 g/m$^2$ for heavy-duty reinforcement. For light reinforcement, therefore, a reticular web produced from a stretched film having a thickness of 20 microns and a basis weight of 20 g/m$^2$ before lateral spreading is transversely spread two times until the web has a basis weight of about 10 g/m$^2$, which corresponds to 900 denier per 10 mm of width. Where the middle portion of the web has that basis weight, the selvages of the web are transversely spread four times until their basis weight corresponds to 450 denier per 10 mm of width. Two parallel flat yarns of 200 denier spaced 10 mm from each other are bonded warpwise to each of such laterally spread selvages, with the result that each selvage including the bonded yarns has a basis weight corresponding to 850 denier per 10 mm of width which is slightly smaller than that of the middle portion of the web. Alternatively, each of the selvages is transversely spread six times and two reinforcement threads of 200 denier are bonded to each selvage. Each such selvage including the two threads has a basis weight equivalent to 550 denier per 10 mm of width, which is substantially half that of the middle portion of the web. With such an arrangement, the roll 43 is wound more tightly at the middle portion 23 than at the selvages 24,25 so that roll 43 will be resistant to forces tending to tumble or collapse itself and hence can be easily handled during shipment and storage for example. The spread web 11 when unwound is stable in dimension especially at the selvages 24,25, which can reliably be guided or supported by suitable guides during subsequent processing.

EXAMPLE 1

A tubular film of high-density polyethylene (HDPE) having a thickness of 0.06 mm and a diameter of 480 mm upon, forming by melt extrusion was water-quenched at a speed of 25 m/min. and slit open longitudinally into an elongate sheet or web having a width of 1.5 m. The sheet was cut by a rotary cutter to form therein discrete cuts or incisions in a staggered arrangement, spaced 3 mm laterally and longitudinally from each other, and having a length of 10 mm, and then was fed into a bath of hot water at 100° C., in which the web was longitudinally stretched 8.5 times the original length to a width of 510 mm and was taken off by nip rollers onto heated drums, on which the web was dried. The web was then transversely spread to a small degree by the cloth guiders 13 as shown in FIGS. 1 and 2 to a width of 620 mm and was caused to travel around the nip rollers 14,15,16, the roller 16 having middle barrel portion of 600 mm in length. Selvages of the web each having a width of 10 mm were transversely spread by an air blast discharged through the holes 21. Two HDPE parallel flat yarns of 200 denier spaced 10 mm from each other and coated with ethylene-vinyl acetate copolymer hot-melt adhesive were bonded warpwise to each of the transversely spread selvages. The web was transversely spread at the middle portion by the guiders 31 two times to a width of 1.2 m, and the web was caused to travel around the heated drums 32,33 at a speed of 200 m/min., to thereby heat-shrink the middle web portion in the longitudinal direction. The web was then coated with hot-melt adhesive by the kiss roller 35, and the adhesive was evenly respread on the heated drums 36–38, followed by cooling on a cooling drum 39. The resultant spread web was 1,250 mm wide and had a basis weight of 10 g/m$^2$, and was wound around the take-up reel 42 at a speed of 200 m/min.

EXAMPLE 2

Two pieces of the sheet having a width of 1.5 m obtained in EXAMPLE 1 were separately given longitudinal discrete cuts and longitudinally stretched six times the original length in a hot-water bath, and then the webs were superposed on each other and additionally longitudinally stretched again to 8.5 times the original length. The longitudinally stretched webs as superposed were dried and thereafter processed as in EXAMPLE 1 into a laterally spread web product having a width of 1.25 mm and a basis weight of 20 g/m$^2$, which is twice that of the product obtained in EXAMPLE 1, and were then wound up into a roll at a speed of 200 m/min.

EXAMPLE 3

Two superposed webs were processed substantially in the same manner as in Example 2, except that the middle web portion was transversely spread four times. The obtained web product had a basis weight of 10 g/m$^2$ and a width of 2.5 m.

Figure 7:
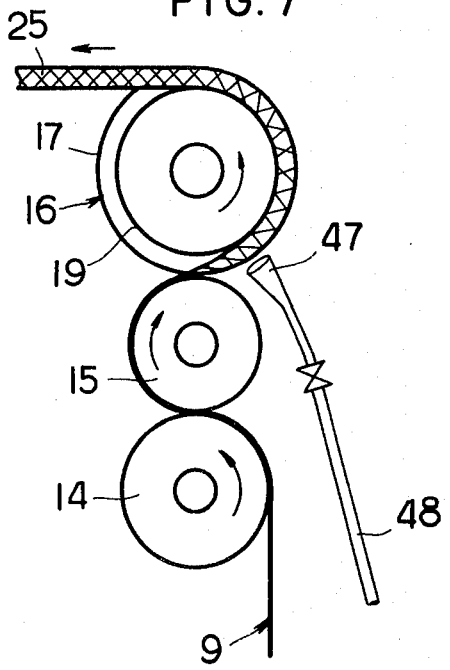
FIG. 7 is a side elevational view of the web spreader shown in FIG. 6.

As shown in FIGS. 6 and 7, a pair of nozzles 46,47 according to another embodiment are disposed adjacent to and directed toward the smaller-diameter portions 18,19, respectively, of the nip roller 16. The nozzles 46,47 are connected to a pipe 48 which is in turn connected to a source of compressed air (not shown) for blowing an air blast through the nozzles 46,47 to the selvages 24,25 of the reticular web 9. The nozzles 46,47 continue to discharge the air blast toward the selvages 24,25 for laterally spreading the latter onto the smaller-diameter roller portions 18,19 of the nip roller 16.

Figure 8:
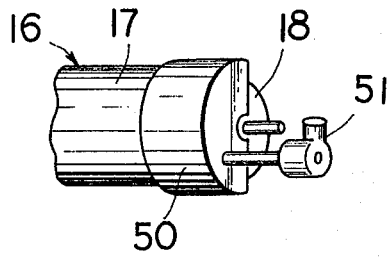
FIG. 8 is a fragmentary perspective view of a web spreader according to another embodiment.
Figure 9:
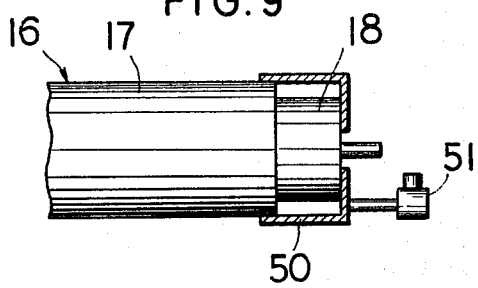
FIG. 9 is a cross-sectional view of the web spreader of FIG. 8.

FIGS. 8 and 9 illustrate still another embodiment in which a casing 50 surrounds a portion of each of the smaller-diameter portions 18,19 of the roller 16. An air suction pump 51 is coupled to the casing 50 to develop air suction in the casing 50 so that the selvages 24,25 of the reticular web 9 can be transversely spread in opposite outward directions within the casings 50, respectively.

Figure 10:
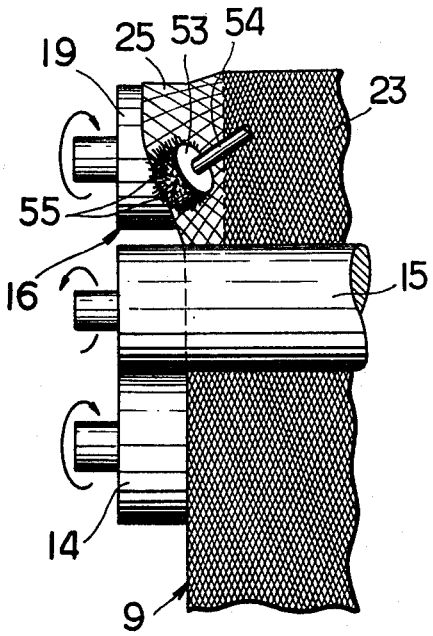
FIG. 10 is an enlarged fragmentary front elevational view of a web spreader according to still another embodiment.
Figure 11:
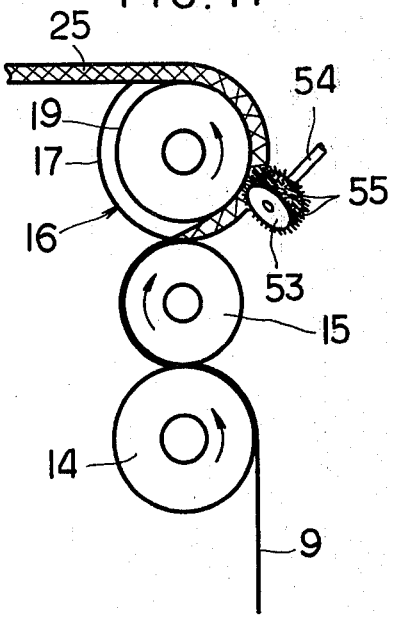
FIG. 11 is a side elevational view of the web spreader shown in FIG. 10.

According to still another embodiment as illustrated in FIGS. 10 and 11, a rotatable brush 53 supported on a shaft 54 is disposed adjacent to each of the smaller-diameter portions 18,19 of the nip roller 16. The brush 53 has a multiplicity of wires 55 projecting radially outwardly for engaging and spreading the selvages 24,25 onto the smaller-diameter roller portions 18,19 upon rotation of the brushes 53.

Although certain preferred embodiments have been shown and described in detail, it should be understood that many changes and modifications may be made therein without departing from the scope of the appended claims.

What is claimed is:

1. A method of manufacturing a reticular web having reinforced and dimensionally stabilized selvages, comprising the steps of:

(a) feeding a longitudinally stretched reticular web of thermoplastic resin composed of warpwise split or slit fibers;

(b) tranversely spreading opposite selvages only of the reticular web;

(c) thereafter, attaching at least one dimensionally stable thread to each of said selvages along the length thereof;

(d) transversely spreading the middle portion of the reticular web between said selvages at a magnification which is smaller than that of said selvages; and (e) heat-shrinking said middle portion longitudinally until it has substantially the same length as that of said selvages, with each selvage having a basis weight which is substantially the same as or smaller than that of said middle porton.

2. A method according to claim 1, said opposite selvages of the reticuar web being transversely spread by blowing an air blast thereto.

3. A method according to claim 1, said opposite selvages of the reticular web being transversely spread by developing air suction thereon.

4. A method according to claim 1, said opposite selvages of the reticular web being transversely spread by a rotating brush held thereagainst.

5. A method of manufacturing a reticular web having reinforced and dimensionally stabilized selvages, comprising the steps of:

(a) feeding a longitudinally stretched reticular web of thermoplastic resin composed of warpwise split or slit fibers;

(b) partly wrapping said reticular web around a roller having a larger-diameter middle portion and opposite smaller-diameter end portions;

(c) simultaneously with said wrapping step, transversely spreading the opposite selvages of said reticular web until they are longitudinally shortened and wrapped around said smaller-diameter portions of said roller;

(d) thereafter, attaching at least one dimensionally stable thread to each of said selvage longitudinally therealong;

(e) transversely spreading said middle portion of the reticular web at a magnification which is smaller than that of said transversely spread selvages; and (f) heat-shrinking said middle portion longitudinally on a hot drum until the middle portion has substantially the same length as that of said selvages, with each selvage having a basis weight which is substantially the same as or smaller than that of said middle portion.

6. A method according to claim 5, said opposite selvages of the reticular web being transversely spread by an air blast blown thereto through holes in a shoulder between said larger-diameter and smaller-diameter portions of said roller.

7. A method according to claim 5, said opposite selvages of the reticular web being transversely spread by blowing an air blast thereto through a nozzle.

8. A method according to claim 5, said opposite selvages of the reticular web being transversely spread by developing air suction in a casing partly covering each of said smaller-diameter portions of said roller.

9. A method according to claim 5, said opposite selvages of the reticular web being transversely spread by a rotating brush disposed adjacent to each of said smaller-diameter portions of said roller.

* * * * *